United States Patent [19]

Gilley et al.

[11] Patent Number: 4,485,610

[45] Date of Patent: Dec. 4, 1984

[54] ACCORDIAN FOLD PACKAGING TRAY

[75] Inventors: James E. Gilley, Fairfield, Conn.; Henry R. Vigue; Wesley C. Sanborn, both of Waterville, Me.

[73] Assignee: Keyes Fibre Company, Waterville, Me.

[21] Appl. No.: 457,371

[22] Filed: Jan. 12, 1983

Related U.S. Application Data

[63] Continuation-in-part of Ser. No. 275,865, Jun. 22, 1981, abandoned.

[51] Int. Cl.[3] ..... B65B 5/00; B65B 5/02; B65B 7/02

[52] U.S. Cl. ..... 53/452; 53/467

[58] Field of Search ..... 53/452, 453, 456, 461, 53/462, 464, 467, 48

[56] References Cited

U.S. PATENT DOCUMENTS

| | | | |
|---|---|---|---|
| 1,911,175 | 5/1933 | Koppelman | 229/28 R |
| 2,071,545 | 2/1937 | Kronenberger | 217/26.5 |
| 2,961,123 | 11/1960 | Boydak | 229/2.5 |
| 3,224,569 | 12/1965 | Leitzel | 206/45.31 |
| 3,286,833 | 11/1966 | Chadbourne | 206/65 |
| 3,355,084 | 11/1967 | Donovan | 229/28.5 EC |
| 3,552,595 | 1/1971 | Gerner | 229/2.5 |
| 3,834,609 | 9/1974 | Congleton | 229/28 R |
| 3,987,956 | 10/1976 | Congleton | 229/28 R |
| 4,057,932 | 11/1977 | Spencer | 229/2.5 |
| 4,108,349 | 8/1978 | Pfaffendorf | 229/15 |
| 4,269,345 | 5/1981 | Emery | 229/2.5 R |

FOREIGN PATENT DOCUMENTS

| | | | |
|---|---|---|---|
| 993812 | 7/1976 | Canada | 229/15 |
| 2202001 | 1/1972 | Fed. Rep. of Germany | 229/15 |
| 2404027 | 1/1974 | Fed. Rep. of Germany | 229/15 |
| 1316575 | 12/1962 | France | 229/2.5 |
| 76478 | 11/1954 | Netherlands . | |
| 349468 | 5/1931 | United Kingdom . | |
| 1165923 | 10/1969 | United Kingdom . | |
| 1517572 | 7/1978 | United Kingdom | 229/15 |

*Primary Examiner*—Horace M. Culver
*Attorney, Agent, or Firm*—Connolly and Hutz

[57] ABSTRACT

An accordian fold molded packaging tray is disclosed having article engaging surfaces thereon which change orientation relative to articles stored in the tray such that when articles are placed in the tray such surfaces help to channel the stored articles into position within the tray and then the surfaces are rotated into engagement or proximity to such stored articles to hold the articles during subsequent shipment and storage. This change in orientation of the article engaging surfaces is accomplished by reduction of the overall dimension of the tray which causes the article engaging surfaces to rotate about fold lines formed in the tray.

6 Claims, 12 Drawing Figures

ACCORDIAN FOLD PACKAGING TRAY

CROSS-REFERENCE TO RELATED APPLICATION

This application is a continuation-in-part of application Ser. No. 06/275,865 filed June 22, 1981, now abandoned.

SUMMARY OF THE INVENTION

The invention provides an inexpensive molded packaging tray for snugly holding bottles or other stored articles. The overall dimension of the tray can be changed by bending along fold lines formed in the tray to facilitate placement of articles in the tray and subsequent safe shipment of such articles. The tray is preferably molded in a configuration wherein the overall dimension of the tray is at its maximum, or expanded position, which results in ease of molding and insertion of stored articles. Thereafter the dimension of the tray is reduced causing portions of the tray to engage and securely hold the articles stored in the tray in place.

BRIEF DESCRIPTION OF THE DRAWINGS

Numerous advantages of the present invention will become apparent to one of ordinary skill in this art from a reading of the detailed description in conjunction with the accompanying drawings, wherein similar reference characters refer to similar parts, and in which.

DETAILED DESCRIPTION

Figure 1:
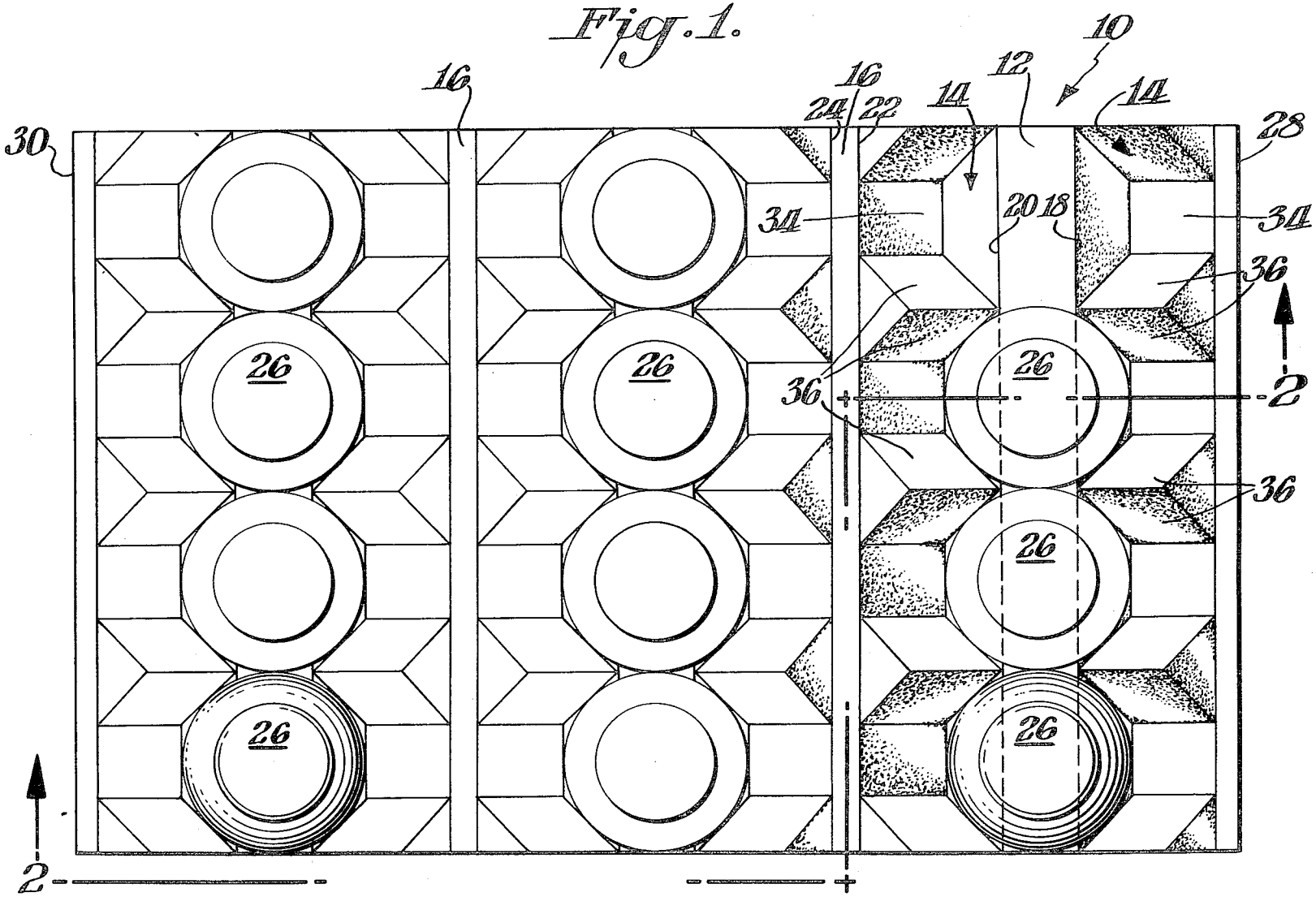
FIG. 1 is a top plan view of one embodiment of the tray of this invention in its expanded or maximum dimension position.
Figure 2:
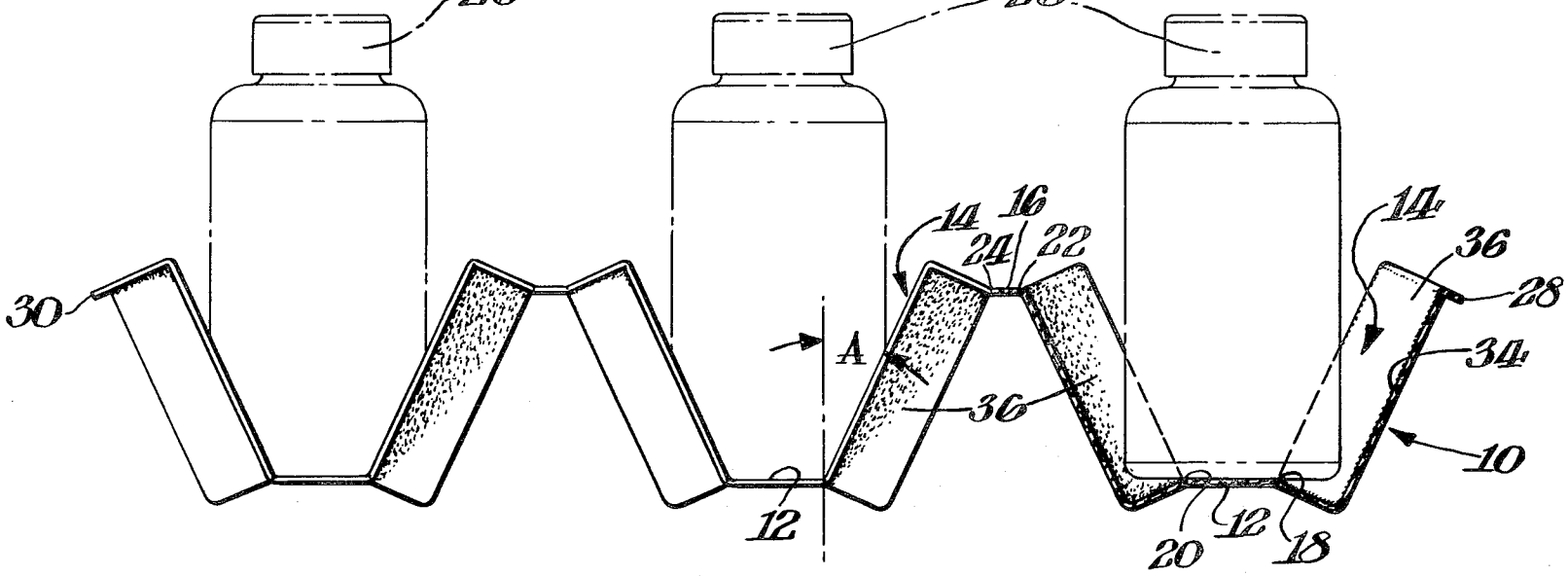
FIG. 2 is a cross-sectional view and partial front elevational view, taken through FIG. 1 along line 2—2 showing the tray of FIG. 1 in its expanded position with articles placed therein.
Figure 3:
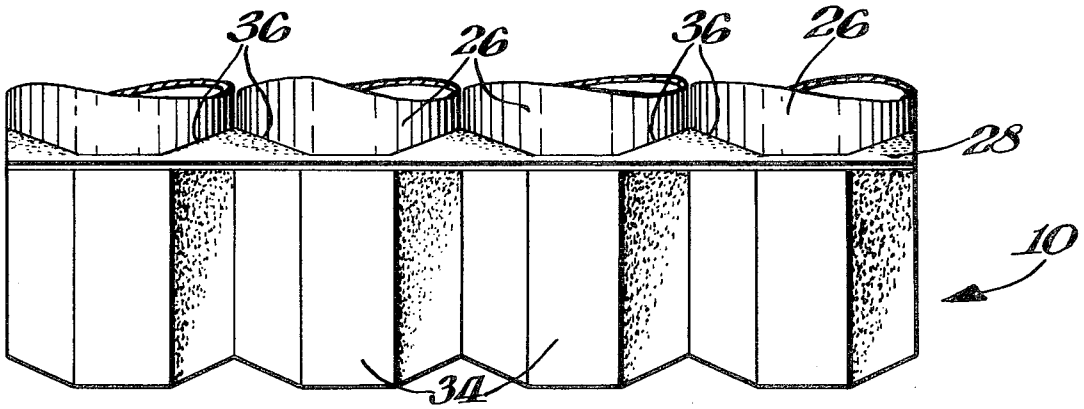
FIG. 3 is a side elevational view of the tray shown in FIGS. 1 and 2.
Figure 4:
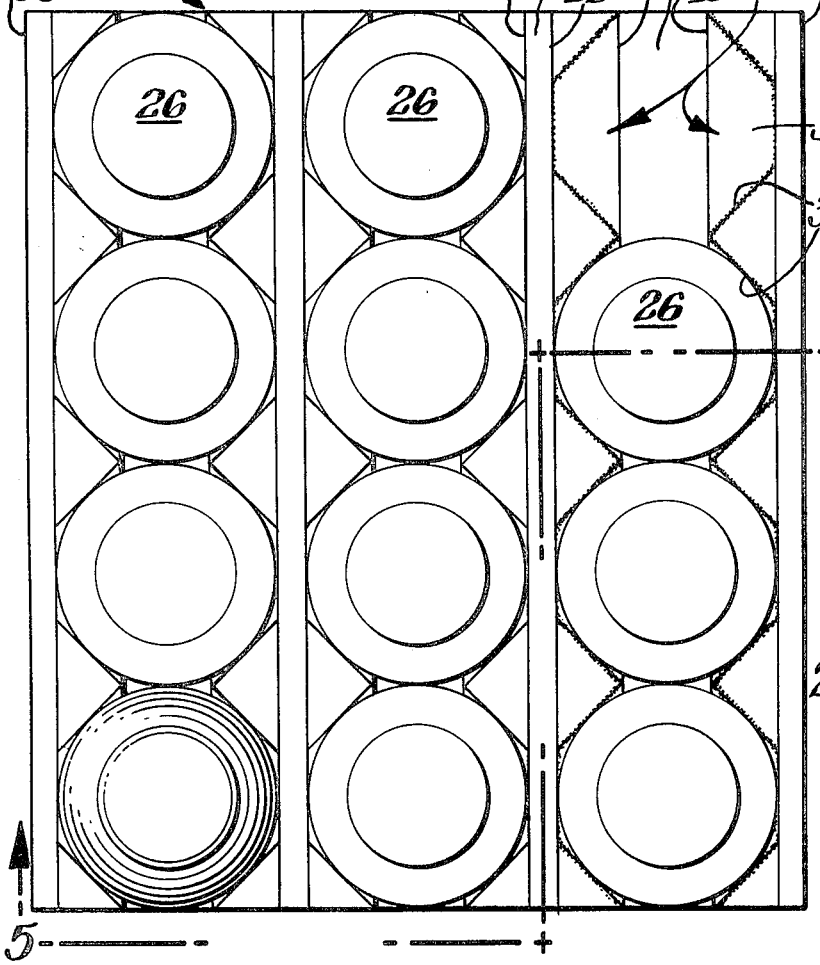
FIG. 4 is a top plan view of the tray of FIG. 1 in its closed or minimum dimension position.
Figure 6:
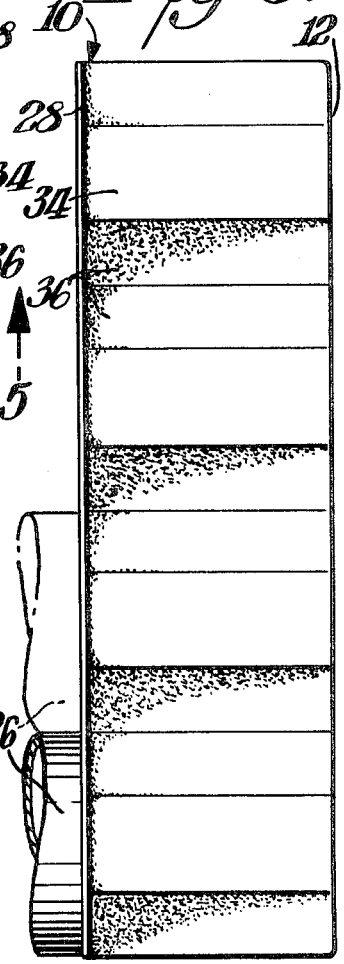
FIG. 6 is a side elevational view of the tray shown in FIGS. 4 and 5.
Figure 5:
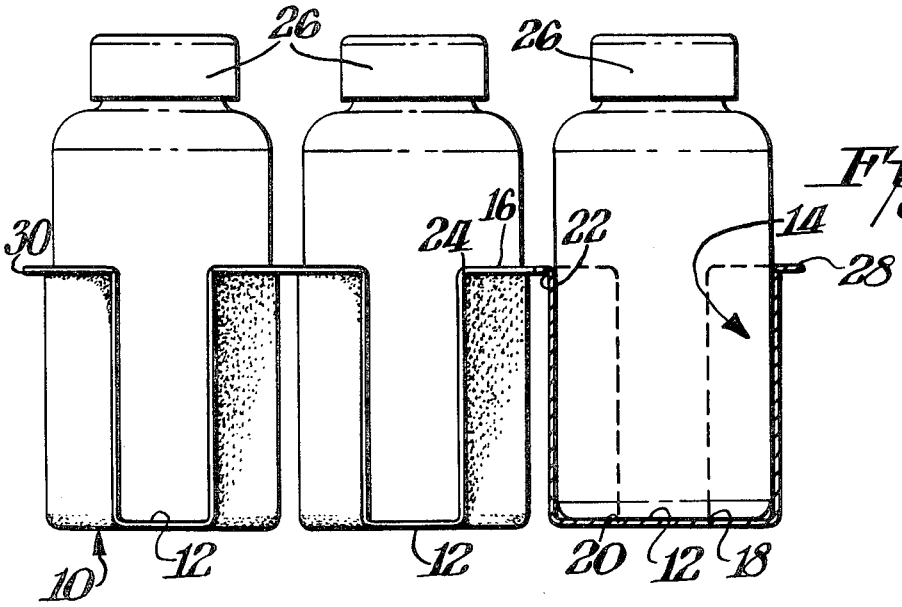
FIG. 5 is a cross-sectional view and partial elevational view, taken through FIG. 4 along line 5—5 showing the tray of FIG. 1 in its closed position with articles stored therein.

FIGS. 1–6 illustrate a tray 10 in accordance with one embodiment of this invention. As indicated therein tray 10 includes a bottom or base 12 and multiple article engaging areas 14 extending from the base 12 to an upper surface 16. As best illustrated in FIGS. 1 and 2, the tray 10 as molded, for example from molded pulp, contains parallel fold lines 18, 20 in base 12 and 22, 24 in the upper surface 16. These fold lines 18, 20, 22 and 24 are formed in the molding process, for example, by reducing the thickness of the tray 10 along these lines. This reduction of thickness can be accomplished by standard molding techniques well-known to those skilled in the art.

The tray 10 as molded is best illustrated in FIG. 2. As shown in this Figure the article engaging areas 14 form an angle "A" with a plane perpendicular to base 12 of 20°–30° which facilitates molding and nesting of the tray 10 itself and, more importantly, provides a "lead-in" for the centering of articles 26 to be stored in the tray 10. This "lead-in" is achieved by the angulation of the article engaging areas 14 with the base which permits wide latitude in placing articles 26 into the tray 10. Typically such articles 26 are placed in packing trays by mechanical packing devices which are difficult to adjust and keep in adjustment. Thus, the tray 10 of this invention which permits wide latitude in placement of the articles 26 in the tray 10 requires less adjustment of packing machinery and therefore less maintenance.

After placement of the articles 26 in the tray 10 one overall dimension of the tray 10 is reduced to bring the article engaging areas into engagement with or close proximity to the stored articles 26. This is achieved by pushing the two ends 28 and 30 of the tray 10 towards each other, for example, by placing the tray 10 on a conveyor belt which passes through an area having sidewalls which taper inward as the tray 10 passes through that area (not illustrated). The sidewalls straddling the conveyor would push the ends 28 and 30 of tray 10 together which in turn would cause the tray 10 to bend along fold lines 18, 20, 22 and 24 in accordian-like fashion. As this occurs, angle A decreases and the article engaging areas 14 become steeper relative to the base 12. The angle A is preferably decreased and one overall dimension of the tray 10 decreased until the article engaging areas 14 are in engagement with or close proximity to the stored articles 26. (see FIGS. 3–6). At this point in the packaging process the tray 10 acts to secure the stored articles 26 in place within the tray 10 and isolate the stored articles 26 from each other and external forces. The latter feature is particularly important where the stored articles are made of glass or other breakable material. After the tray 10 is suitably compressed to hold the stored articles 26 in place the compressed tray may then be placed in a suitable carton 32 (see FIG. 7) or other overwrap for shipment to the consumer.

The article engaging areas 14 shown in the embodiment of this invention illustrated in FIGS. 1–6 are essentially L-shaped surfaces 34 extending between fold lines 18 and 20 in the base 12 and fold lines 22 and 24 in the upper surface 16 (or ends 28 and 30) with projections 36 extending from this surface 34 into the areas between adjoining articles 26 stored in tray 10. As illustrated in FIGS. 1–6 these projections 36 are triangular shaped when viewed from the top of the tray 10, however, these projections 36 may be of any shape which will best conform to the shape of the stored articles 26.

Figure 7:
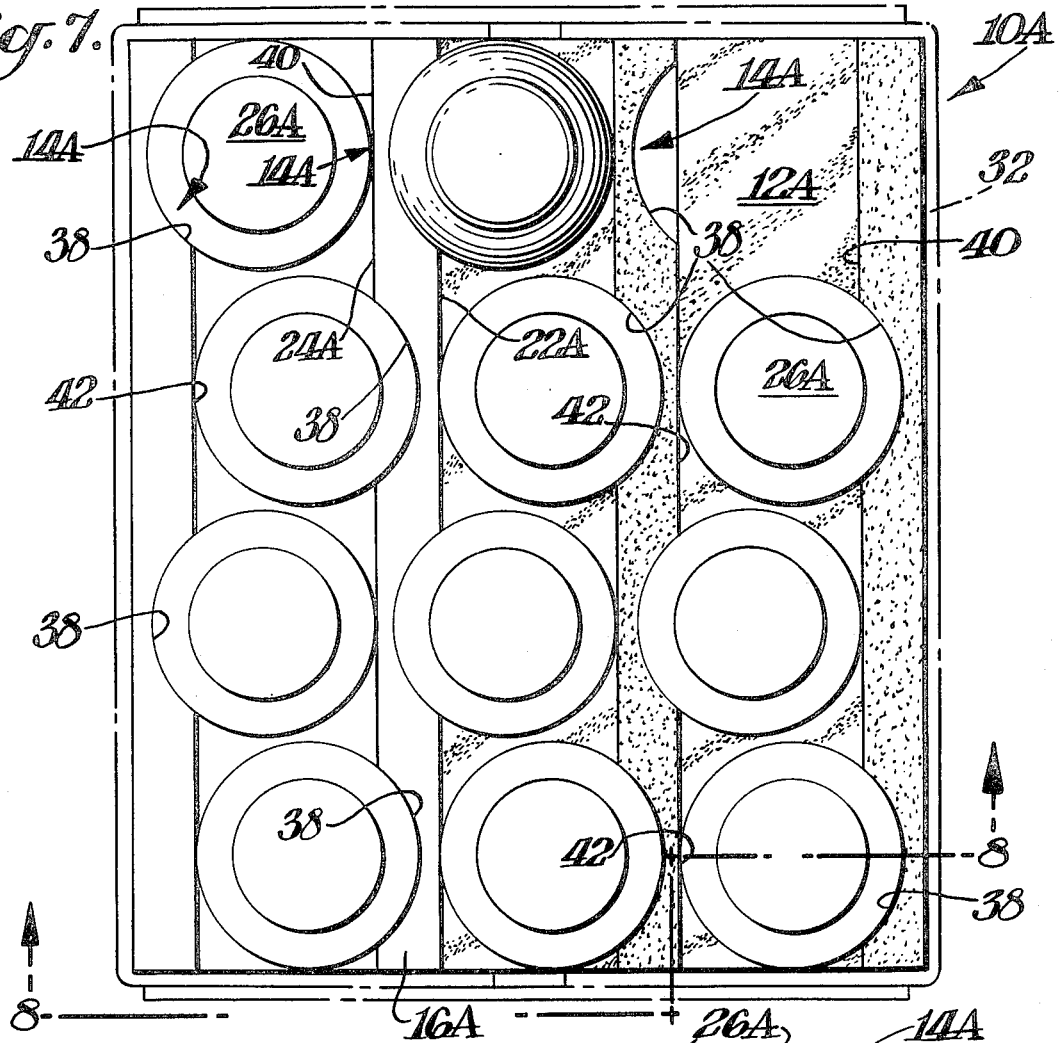
FIG. 7 is a top plan view of another embodiment of the tray of this invention in its closed or minimum dimension position with articles stored therein and placed within a carton or similar overwrap.
Figure 8:
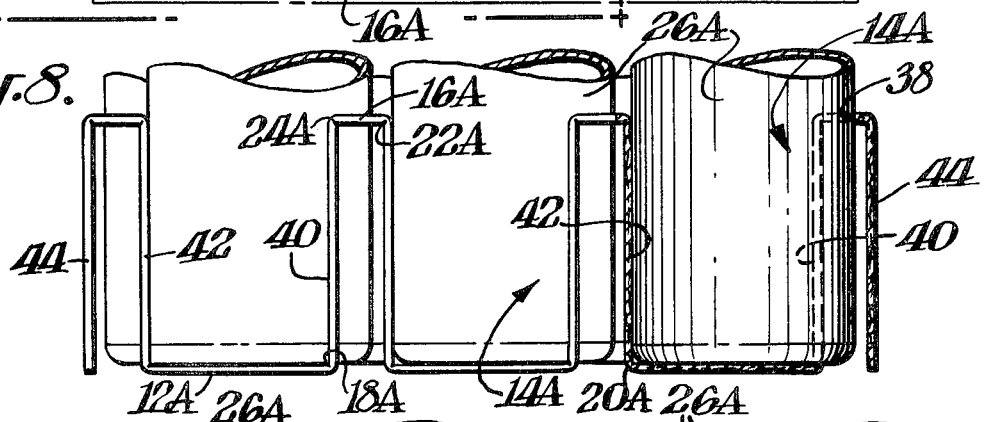
FIG. 8 is a cross-sectional view and partial front elevational view, taken through FIG. 7 along line 8—8.
Figure 9:
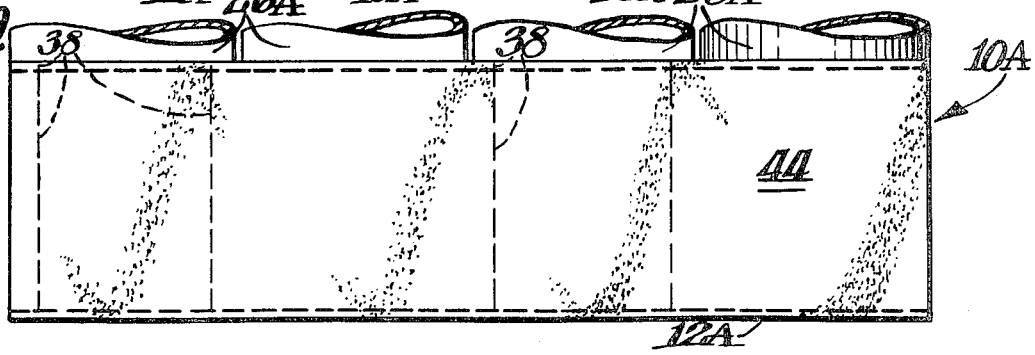
FIG. 9 is a side elevational view of the tray shown in FIGS. 7 and 8.

FIGS. 1–6 are directed to the practice of the invention wherein the article engaging areas 14 have projections 36 which extend into areas between adjacent stored articles 26 on two sides of such articles 26. The invention, however, may also be practiced in other manners. For example, FIGS. 7–9 illustrate the practice of the invention where article engaging areas 14A contain no projections but rather a cutout 38 in one of such areas 14A which cutout generally corresponds to the configuration of the stored article 26. This cutout 38 is formed in the area between adjacent fold lines 22A and 24A in the upper surface 16A of the tray 10A of this embodiment or between one of these fold lines and end skirt 44. In this embodiment when the overall dimension of the tray 10A is reduced the stored articles 26A are held from moving lengthwise along the tray 10A by the multipoint engagement of the cutout 38 with the stored article 26A and are restrained in the other direction by the vertical surfaces 40 and 42 of the complementary article engaging area 14A (see FIG. 7). In this embodiment a single thickness of the article engaging area 14A separates adjoining articles stored in the tray 10A thereby maximizing the number of articles 26A which may be stored in a given tray area. The remaining structure and function of this alternate embodiment of the invention is generally similar to the prior embodiment and accordingly like reference numerals have been used for like parts but designated by the suffix "A".

Figure 10:
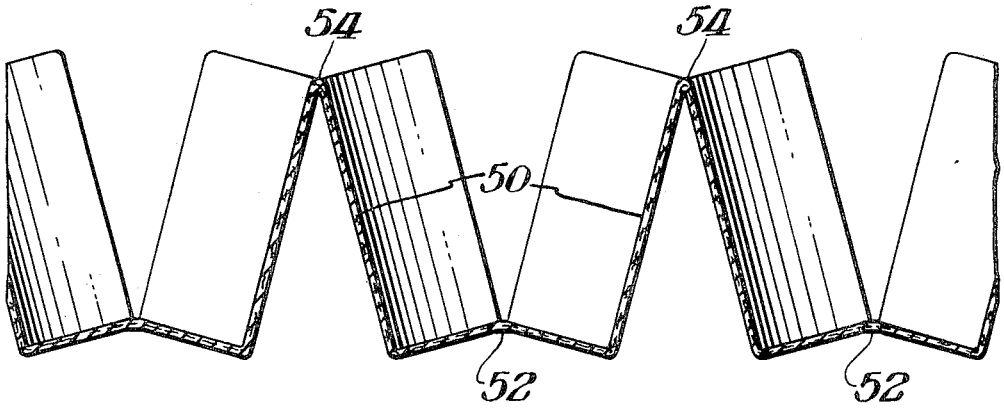
FIG. 10 is a fragmentary cross-sectional view of yet another embodiment of the tray of this invention in the original as molded first shape.

FIG. 10 shows, in semi-schematic fragmentary cross-sectional elevational view, yet another embodiment of an accordian fold packaging tray according to this invention. As with the embodiments disclosed above, the tray comprises at least two longitudinal rows of compartments with at least two such compartments in each row, each compartment having article engaging sidewall areas 50. The tray is molded to a first deeply contoured shape, as shown in FIG. 10, having no vertical walls, wherein like empty trays may be nested one within another in a stack thereof for shipment and storage. This tray has predetermined first longitudinal fold lines 52 along the bottom of each row of compartments, and predetermined second longitudinal fold lines 54 along upper surfaces of the tray between each row of compartments. As with the other embodiments disclosed above, the tray according to FIG. 10 is capable of changing dimensions to a final shape wherein the width of the tray is decreased, and the article engaging sidewall areas 50 become substantially vertical, the dimension changes occurring around the first and second fold lines in accordian fashion. The amount of bending around each fold line to change the tray from the first shape to the final shape is no greater than about 30 degrees, and this permits articles to be packaged in the compartments, that is received and retained in the compartments, before the tray is changed from its first shape to its decreased width final shape.

Figure 11:
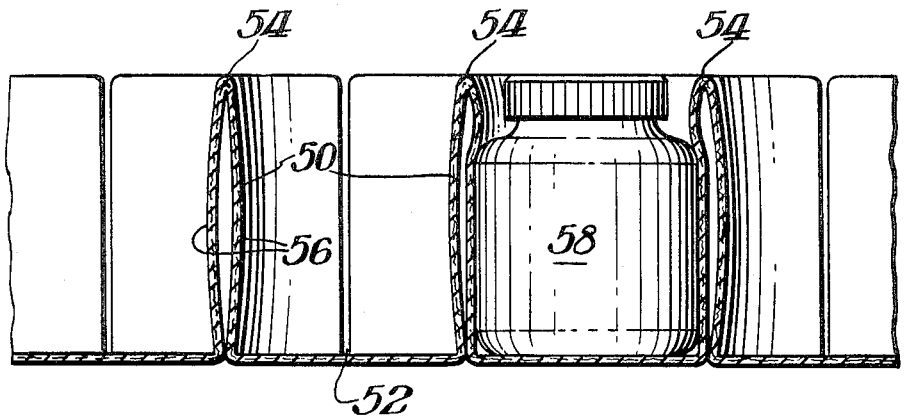
FIG. 11 is a similar view of the tray of FIG. 10 in the compressed final shape, with an article in one of the compartments; and, FIG. 12 is a view of the tray of FIG. 10 unsecured from the final shape whereupon it has resumed part of its first shape.

With reference to FIG. 11, when the tray is compressed from its first shape to its final shape, the resiliency of the pulp material from which the tray is molded, particularly at the upper or second fold lines 54, is such that the originally straight article engaging sidewall areas 50 of each compartment are bowed inwardly, as at 56 (exaggerated for purposes of clarity in FIG. 11). This is a slight inward bowing, which occurs when the tray is compressed to the final shape, and it provides more effective engagement with the articles already packaged in, or to be packaged in, the individual compartments, including some degree of cushioning. With articles such as apples, for instance, they would be positioned in the compartments before the tray is compressed to the final shape, and the inward bowing tendency of the resilient sidewall areas 50 causes them to slightly surround or clasp each apple in each compartment, as can be understood, further insuring against undesired rotational or other movement of each article in each compartment during shipment. With articles such as jars, for example the jar 58, the slight inward bowing tendency of the sidewall areas 50 serves to better grip the jars, although the jars similarly will displace the sidewalls to their substantially vertical orientation corresponding to the shape of the jar walls. The resiliency of the sidewall areas 50, moreover, is such that articles such as jars, which are not bruised easily as is the skin of delicate articles such as apples, may be inserted downwardly into the compartments after the tray has been compressed to its final shape, if desired, spreading the inwardly bowed sidewalls as required to accommodate the jars. Alternatively, of course, the articles may be received and retained in the compartments before the tray is compressed from its first to its final shape, as would be preferred with delicate or fragile articles.

Figure 12:
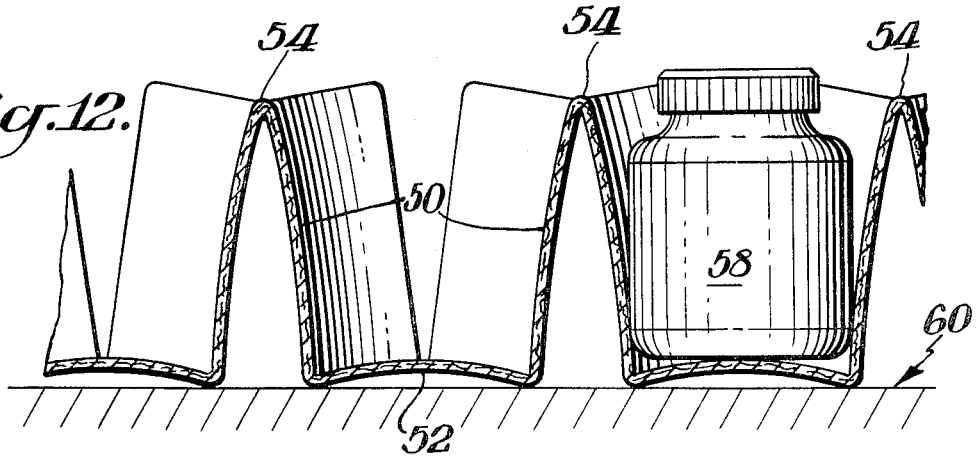

Another feature of the accordian fold packaging trays according to this invention is illustrated in FIG. 12. As explained above, a tray with articles such as jars 58 or the like in the compartments is secured in the final compressed shape, such as by placing the loaded tray in a shipping or other container whose dimensions correspond to those of the tray in the final shape. When it is desired to unpack the individual articles, the trays according to this invention may be removed from the shipping container, fully packed with articles. When placed on a flat surface 60, such as a table top or the floor of a retail establishment, the inherent resiliency of the fibrous pulp material of which the tray is molded causes the tray to "spring back" somewhat and resume part but usually not all of its first shape. The amount of expansion back from the final compressed shape will depend on a number of factors, including the thickness and resiliency of the molded pulp material, the weight of the jars or other articles packaged in the compartments, the frictional characteristics of the surface on which the filled tray is placed, and the like. For example, a thinner more flexible tray packaged with heavy articles such as filled jars placed on a deep pile rug surface will not expand back as much as a stiffer more resilient tray packaged with lighter articles such as apples placed on a smooth linoleum surface, as can be appreciated. Whatever part of the original as molded first shape is resumed by this resilient feature of the trays according to this invention, the resumption of part of the expanded first shape spreads open the sidewalls of the compartments to some extent and thus facilitates removal of the individual articles from the individual compartments, for example speeding the manual operation of removing the articles one by one from the accordian fold packaging tray and placing them on display shelves for retail sale.

As is apparent the invention may be practiced in various manners including the particularly illustrated embodiments. For example, various configurations of article engaging areas may be utilized depending upon the shapes and sizes of articles being stored and shipped in the tray.

While the above embodiments constitute the presently preferred mode of practicing this invention, other embodiments and equivalents are within the scope of the actual invention, which is set forth in the claims which follow.

We claim:

1. A process for packaging a plurality of articles in separate compartments for shipment and storage, comprising the steps of: (A) providing a tray having a first deeply contoured shape including at least two longitudinal rows of article receiving compartments with at least two such compartments in each row, each compartment having article engaging sidewall areas, the tray in the first shape having no vertical walls so that a number of like empty trays may be nested one within another in a stack, the tray in the first shape being capable of receiving and retaining articles in the compartments, and (B) providing in the tray at least one predetermined first longitudinal fold line along the bottom of each row of compartments and at least one predetermined second longitudinal fold line along an upper surface of the tray between each row of compartments; (C) applying a horizontal compressing force to change the dimensions of the tray from the first shape to a final shape wherein the width of the tray is decreased, the dimension changes occurring in accordian fold fashion around the first and second fold lines, the amount of folding around each fold line to change the tray from the first shape to the final shape being no greater than about 30°; (D) placing articles in the compartments, either before or after the dimensions of the tray are changed from the first shape; and finally (E) securing the tray in the final shape whereby the articles packaged in the tray are contacted by the article engaging sidewall areas of the compartments.

2. A process for packaging a plurality of articles as in claim 1 wherein the amount of bending around the fold lines along the bottom of each row of compartments, and the amount of bending around the fold lines along the upper surface between each row of compartments, is substantially equal.

3. A process for packaging a plurality of articles as in claim 2 wherein the dimension changes in response to the horizontal compressing force decrease the width of the tray from the first shape to the final shape by no more than about 44%.

4. A process for packaging a plurality of articles as in claim 3 wherein the decrease in the width of the tray is accompanied by a commensurate increase in the effective depth of the article compartments.

5. A process for packaging a plurality of articles as in claim 1 wherein the tray is molded to its first deeply contoured shape from fibrous pulp material, and the limited bending around the fold lines to the final shape does not rupture the molded pump material to the extent that any significant weakness is created.

6. A process for packaging a plurality of articles as in claim 1 wherein the tray is secured in the final shape by placing the tray in a container whose dimensions correspond to those of the tray in the final shape.

* * * * *